US005843563A

United States Patent [19]

Tuyuguchi et al.

[11] Patent Number: 5,843,563

[45] Date of Patent: Dec. 1, 1998

[54] THERMAL TRANSFER RECORDING MEDIUM FOR COLOR IMAGE FORMATION

[75] Inventors: Hiromi Tuyuguchi; Jun Sogabe, both of Osaka, Japan

[73] Assignee: Fujicopian Co., Ltd., Osaka, Japan

[21] Appl. No.: 519,488

[22] Filed: Aug. 25, 1995

[30] Foreign Application Priority Data

Aug. 26, 1994 [JP] Japan ..... 6-201784

[51] Int. Cl.[6] ..... B41M 5/20

[52] U.S. Cl. ..... 428/212; 428/195; 428/207; 428/484; 428/488.1; 428/913

[58] Field of Search ..... 428/195, 207, 428/212, 484, 488.1, 913

[56] References Cited

FOREIGN PATENT DOCUMENTS 59-209196 11/1984 Japan ..... B41M 5/26

1-281992 5/1988 Japan ..... B41M 5/26

*Primary Examiner*—Pamela H. Schwartz

*Attorney, Agent, or Firm*—Fish & Neave

[57] ABSTRACT

A thermal transfer recording medium for forming a multi-color or full-color image including at least one region wherein different color ink dots are superimposed one on another to develop a color by virtue of subtractive color mixture, comprising a foundation, and a yellow heat-meltable ink layer, a magenta heat-meltable ink layer and a cyan heat-meltable ink layer disposed on the foundation in a side-by-side relation in a predetermined order, and respective release layers each comprising a wax interposed between the foundation and the respective color ink layers, the melt viscosities at a predetermined temperature of the respective release layers corresponding to the respective color ink layers being stepwise decreased in the order in which the respective color ink layers are transferred. A thermal transfer recording medium wherein the respective color ink layers are provided on separate foundations is included.

8 Claims, 3 Drawing Sheets

THERMAL TRANSFER RECORDING MEDIUM FOR COLOR IMAGE FORMATION

BACKGROUND OF THE INVENTION

The present invention relates to a thermal transfer recording medium for use in thermal transfer recording devices such as thermal printers and facsimile terminal equipments. More particularly, the present invention relates to a thermal transfer recording medium favorably used for forming a multi-color or full-color image containing a region wherein different color ink dots are superimposed one on another to develop a color by virtue of subtractive color mixture.

There has hitherto been known a thermal transfer recording medium for forming an image of high quality even on a paper sheet having poor surface smoothness (hereinafter referred to as "rough paper") which has on a foundation a bridgingly transferable heat-meltable ink layer capable of being transferred as bridging over depressed portions of a rough paper while adhering not to the depressed portions but only to projecting portions thereof.

Such a bridgingly transferable ink layer has a composition wherein the proportion of a resin is predominant, from the viewpoints of increasing the cohesive force when transferring and enhancing adhesion to a rough paper. However, this enhances adhesion of the ink layer to the foundation, resulting in poor transferability. In order to solve this problem, generally, a release layer composed predominantly of a wax having a low melting point and a low melt viscosity is interposed between the foundation and the ink layer.

On the other hand, there has been conducted the formation of a multi-color or full-color image wherein at least two of a yellow heat-meltable ink layer, a magenta heat-meltable ink layer and a cyan heat-meltable ink layer are superimposingly transferred onto a receptor paper to superimpose different color ink dots one or another on the receptor paper, thereby forming a multi-color or full-color image containing at least a region developing a color by virtue of subtractive color mixture.

When the formation of a multi-color or full-color image using a bridgingly transferable thermal transfer recording medium having the above-mentioned construction is attempted, the release layer would be present on the top of ink dots formed on the receptor paper. When ink dots of another color are superimposingly transferred onto these ink dots, the ink layer of the ink dots to be transferred is superimposed on the release layer present on the top of the ink dots which have already been transferred on the receptor paper.

Herein, the ink dot being present directly on the receptor is referred to as "first color ink dot", the ink dot being superimposed on the first color ink dot as "second color ink dot", and the ink dot being superimposed on the second color ink dot as "third color ink dot". The ink layers forming the first color ink dots, the second color ink dots and the third color ink dots are referred to as "first color ink layer", "second color ink layer" and "third color ink layer", respectively. The color exhibited by the first color ink dots, the color exhibited by the mutually superimposed first color ink dots and second color ink dots, and the color exhibited by the mutually superimposed first color ink dots, second color ink dots and third color ink dots are referred to as "first color", "second color" and "third color", respectively.

However, when a multi-color or full-color image is formed using a bridgingly transferable thermal transfer recording medium having the above-mentioned construction, there is a problem that second color ink dots to be transferred onto first color ink dots are not transferred in a perfect dot form onto the first color ink dots, and third color ink dots to be transferred onto the second color ink dots are not transferred in a perfect dot form onto the second color ink dots and, hence, the development of a color by virtue of subtractive color mixture is not favorably exhibited, resulting in poor color reproduction and failure to form a multi-color or full-color image of high quality.

This problem will be explained by referring to the drawing.

FIG. 5 is a sectional view showing a condition where a second color ink dot is transferred onto a first color ink dot formed on a receptor (rough paper). In FIG. 5, a first color ink dot D1 is formed on a rough paper P. The first color ink dot D1 is composed of a colored ink layer 12(D1) and a release layer 13(D1) lying on the top of the colored ink layer 12(D1). The ink layer (second color ink layer 12) of a thermal transfer recording medium 10 is superposed on the rough paper P on which the first color ink dot D1 has been formed. The combined recording medium/rough paper is heated from the foundation side of the recording medium 10 with a thermal head T (in FIG. 5, only one heat-generating element is illustrated) and the recording medium 10 is then peeled off from the rough paper P, resulting in formation of a second color ink dot D2 on the first color ink dot D1. The second color ink dot D2 is composed of a colored ink layer 12(D2) and a release layer 13(D2) lying on the top of the colored ink layer 13(D2).

When the second color ink dot D2 is superimposingly transferred onto the first color ink dot D1 formed on the rough paper P, the colored ink layer 12(D2) of the second color ink dot D2 is permitted to adhere to the release layer 13(D1) of the first color ink dot D1.

Herein the internal cohesive force of the release layer 13(D1) of the first color ink dot D1 is taken as F1 and the internal cohesive force of the release layer 13(D2) of the second color ink dot D2 is taken as F2. Since the release layer 13(D1) and the release layer 13(D2) generally have the same composition, F1 and F2 are the same magnitude. In the case that the thermal transfer recording medium 10 is peeled off from the rough paper P under these conditions, as shown in FIG. 5, the probability that cohesion failure occurs within the release layer 13(D2) of the second color ink dot D2 is approximately the same degree as the probability that cohesion failure occurs within the release layer 13(D1) of the first color ink dot D1, so that there occurs a phenomenon that some portion of the second color ink dot D2 is transferred on the first color ink dot D1 but the remaining portion of the second color ink dot D2 remains on the recording medium side, resulting in failure to obtain a perfect second color ink dot D2 conforming to the shape of the heat-generating element on the first color ink dot D1. The same phenomenon as mentioned above also occurs when a third color ink dot is transferred onto the second color ink dot.

It is an object of the present invention to provide a thermal transfer recording medium for color image formation having a release layer composed of a wax as a main component interposed between respective colored ink layers and the foundation, which is capable of transferring a perfect second color ink dot onto a first color ink dot and further a perfect third color ink dot onto the second color ink dot, thereby forming a multi-color or full-color image of high quality with good color reproducibility.

This and other objects of the present invention will become apparent from the description hereinafter.

SUMMARY OF THE INVENTION

According to a first aspect of the present invention, there is provided a thermal transfer recording medium for color image formation for use in a method for forming a color image comprising selectively heat-transferring at least two of a yellow heat-meltable ink layer, a magenta heat-meltable ink layer and a cyan heat-meltable ink layer on a receptor in a predetermined order, thereby forming a color image comprising (A1) at least one region wherein at least two different color ink dots of the yellow ink, magenta ink and cyan ink are present in a superimposed state to develop a color by virtue of subtractive color mixture, or a color image comprising (B1) the foregoing region (A1) and at least one region of single color wherein at least one color ink dots of the yellow ink, magenta ink and cyan ink are present in a non-superimposed state, the thermal transfer recording medium comprising a single foundation, and a yellow heat-meltable ink layer, a magenta heat-meltable ink layer and a cyan heat-meltable ink layer disposed on the foundation in a side-by-side relation in a predetermined order, and respective release layers each comprising a wax interposed between the foundation and the respective color ink layers, the melt viscosities at a predetermined temperature of the respective release layers corresponding to the respective color ink layers being stepwise decreased in the order in which the respective color ink layers are transferred.

According to a second aspect of the present invention, there is provided a thermal transfer recording medium for color image formation for use in a method for forming a color image comprising selectively heat-transferring at least three of a yellow heat-meltable ink layer, a magenta heat-meltable ink layer, a cyan heat-meltable ink layer and a black heat-meltable ink layer on a receptor in a predetermined order, thereby forming a color image comprising (A1) at least one region wherein at least two different color ink dots of the yellow ink, magenta ink and cyan ink are present in a superimposed state to develop a color by virtue of subtractive color mixture and (A2) at least one region developing a black color wherein black ink dots are present in a superimposed state on at least one color ink dots of the yellow ink, magenta ink and cyan ink or on at least two superimposed ink dots of the yellow ink, magenta ink and cyan ink, or a color image comprising (B2) the foregoing regions (A1) and (A2) and at least one region of single color wherein at least one color ink dots of the yellow ink, magenta ink, cyan ink and black ink are present in a non-superimposed state, the thermal transfer recording medium comprising a single foundation, and a yellow heat-meltable ink layer, a magenta heat-meltable ink layer, a cyan heat-meltable ink layer and a black heat-meltable ink layer disposed on the foundation in a side-by-side relation in a predetermined order, and respective release layers each comprising a wax interposed between the foundation and the respective color ink layers, the melt viscosities at a predetermined temperature of the respective release layers corresponding to the respective color ink layers being stepwise decreased in the order in which the respective color ink layers are transferred.

According to a third aspect of the present invention, there is provided an assembly of plural thermal transfer recording media for color image formation for use in a method for forming a color image comprising selectively heat-transferring at least two of a yellow heat-meltable ink layer, a magenta heat-meltable ink layer and a cyan heat-meltable ink layer on a receptor in a predetermined order, thereby forming a color image comprising (A1) at least one region wherein at least two different color ink dots of the yellow ink, magenta ink and cyan ink are present in a superimposed state to develop a color by virtue of subtractive color mixture, or a color image comprising (B1) the foregoing region (A1) and at least one region of single color wherein at least one color ink dots of the yellow ink, magenta ink and cyan ink are present in a non-superimposed state, the assembly comprising a first thermal transfer recording medium comprising a foundation, a release layer comprising a wax provided on the foundation and a yellow heat-meltable ink layer provided on the release layer, a second thermal transfer recording medium comprising a foundation, a release layer comprising a wax provided on the foundation and a magenta heat-meltable ink layer provided on the release layer, and a third thermal transfer recording medium comprising a foundation, a release layer comprising a wax provided on the foundation and a cyan heat-meltable ink layer provided on the release layer, the melt viscosities at a predetermined temperature of the respective release layers corresponding to the respective color ink layers being stepwise decreased in the order in which the respective color ink layers are transferred.

According to a fourth aspect of the present invention, there is provided an assembly of plural thermal transfer recording media for color image formation for use in a method for forming a color image comprising selectively heat-transferring at least two of a yellow heat-meltable ink layer, a magenta heat-meltable ink layer, a cyan heat-meltable ink layer and a black heat-meltable ink layer on a receptor in a predetermined order, thereby forming a color image comprising (A1) at least one region wherein at least two different color ink dots of the yellow ink, magenta ink and cyan ink are present in a superimposed state to develop a color by virtue of subtractive color mixture and (A2) at least one region developing a black color wherein black ink dots are present in a superimposed state on at least one color ink dots of the yellow ink, magenta ink and cyan ink or on at least two superimposed ink dots of the yellow ink, magenta ink and cyan ink, or a color image comprising (B2) the foregoing regions (A1) and (A2) and at least one region of single color wherein at least one color ink dots of the yellow ink, magenta ink, cyan ink and black ink are present in a non-superimposed state, the assembly comprising a first thermal transfer recording medium comprising a foundation, a release layer comprising a wax provided on the foundation and a yellow heat-meltable ink layer provided on the release layer, a second thermal transfer recording medium comprising a foundation, a release layer comprising a wax provided on the foundation and a magenta heat-meltable ink layer provided on the release layer, a third thermal transfer recording medium comprising a foundation, a release layer comprising a wax provided on the foundation and a cyan heat-meltable ink layer provided on the release layer and a fourth thermal transfer recording medium comprising a foundation, a release layer comprising a wax provided on the foundation and a black heat-meltable ink layer provided on the release layer, the melt viscosities at a predetermined temperature of the respective release layers corresponding to the respective color ink layers being stepwise decreased in the order in which the respective color ink layers are transferred.

In an embodiment of each of the first and third aspects of the present invention, the melt viscosity $\eta_1$ of the release layer corresponding to one of the yellow, magenta and cyan ink layers and the melt viscosity $\eta_2$ of the release layer corresponding to another of the yellow, magenta and cyan ink layers have a relationship represented by the formula:

$$\eta_2/\eta_1<0.7$$

provided that the transfer of the one ink layer is precedent to that of the another ink layer.

In an embodiment of each of the second and fourth aspects of the present invention, the melt viscosity $\eta_1$ of the release layer corresponding to one of the yellow, magenta, cyan and black ink layers and the melt viscosity $\eta_2$ of the release layer corresponding to another of the yellow, magenta, cyan and black ink layers have a relationship represented by the formula:

$$\eta_2/\eta_1<0.7$$

provided that the transfer of the one ink layer is precedent to that of the another ink layer.

DETAILED DESCRIPTION

In the present invention, respective release layers interposed between a foundation (a single foundation or separate foundations), and a yellow heat-meltable ink layer, a magenta heat-meltable ink layer and a cyan heat-meltable ink layer have decreasing melt viscosities at a predetermined temperature in the order in which the respective color ink layers are transferred.

Figure 5:
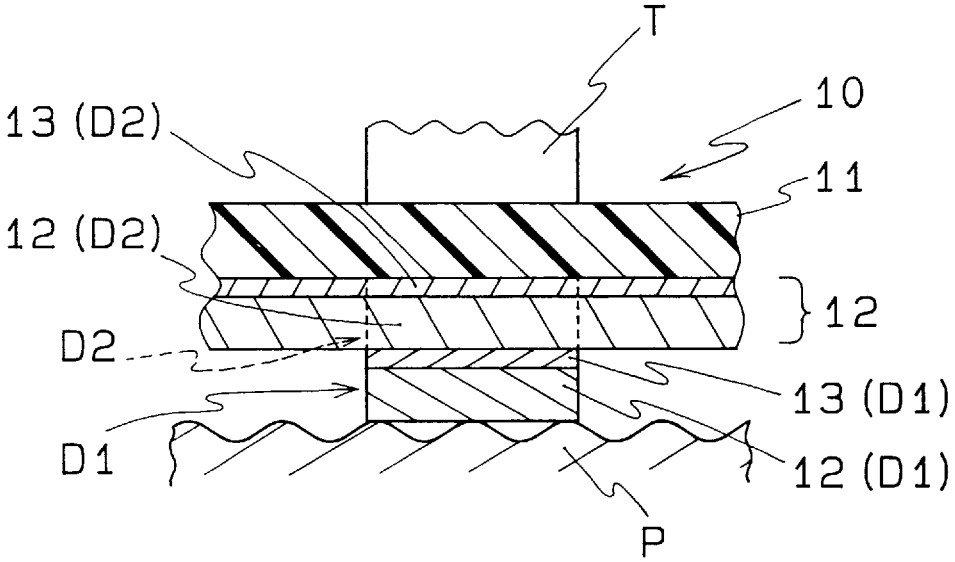
FIG. 5 is a schematic sectional view showing a condition where a second color ink dot is transferred onto a first color ink dot.

Favorable results obtained by virtue of this feature are explained by referring to FIG. 5. The internal cohesive force F1 of the release layer 13(D1) of the first color ink dot D1 is significantly larger than the internal cohesive force F2 of the release layer 13(D2) of the second color ink dot D2. When the thermal transfer recording medium 10 is peeled off from the rough paper P, cohesive failure surely occurs within the release layer 13(D2) of the second color ink dot D2, while no cohesive failure occurs within the release layer 13(D1) of the first color ink dot. Accordingly, a second color ink dot D2 which has an almost perfect shape conforming to the shape of the heat-generating element is formed on the first color ink dot D1. The same results are also obtained when a third color ink dot is transferred onto the second color ink dot.

According to the present invention, desired respective color separation images can be obtained and, hence, a desired color mixture results, thereby forming a multi-color or full-color image of high quality with good color reproducibility.

The present invention will be more specifically explained.

Figure 1:
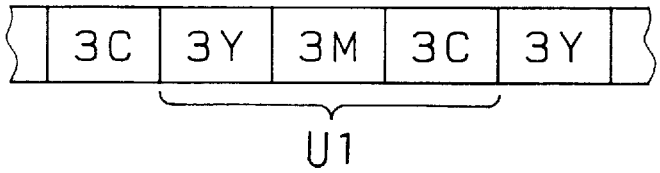
FIG. 1 is a partial plan view showing an example of a thermal transfer recording medium according to the first aspect of the present invention.
Figure 2:
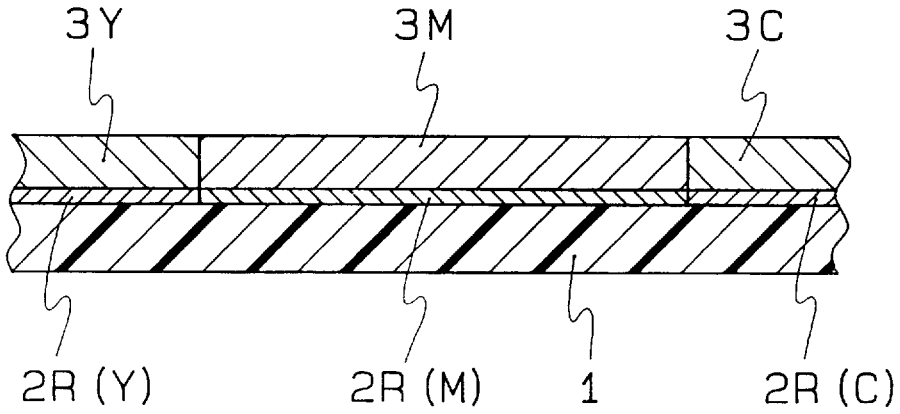
FIG. 2 is a partial sectional view showing the example illustrated in FIG. 1.

FIG. 1 is a partial plan view showing an example of a thermal transfer recording medium according to the first aspect of the present invention, and FIG. 2 is a partial sectional view of this example.

In FIGS. 1 and 2, a release layer 2R(Y), a release layer 2R(M) and a release layer 2R(C) are disposed on a single foundation 1 in a side-by-side relation, and a yellow heat-meltable ink layer 3Y, a magenta heat-meltable ink layer 3M and a cyan heat-meltable ink layer 3C are disposed on the release layers 2R(Y), 2R(M) and 2R(C), respectively. The ink layers 3Y, 3M and 3C (also the release layers 2R(Y), 2R(M) and 2R(C)), each of which preferably has a given constant size, are periodically repeatedly arranged in a side-by-side relation in the longitudinal direction of the foundation 1 in a repeating unit U1 wherein the ink layers 3Y, 3M and 3C are arranged in a predetermined order. The order of arrangement of the three color ink layers 3Y, 3M and 3C in the repeating unit U1 can be arbitrarily determined according to the order of transfer of the three color ink layers 3Y, 3M and 3C.

In the case that the ink layers are transferred in the order of 3Y, 3M and 3C, the melt viscosities of the release layers are stepwise decreased in the order of 2R(Y), 2R(M) and 2R(C).

Figure 3:
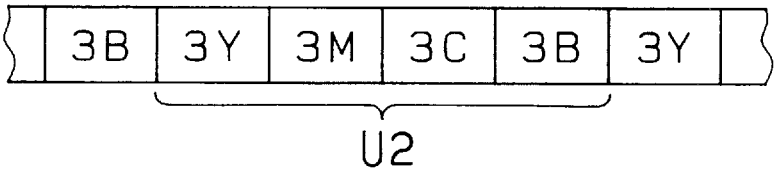
FIG. 3 is a partial plan view showing an example of a thermal transfer recording medium according to the second aspect of the present invention.
Figure 4:
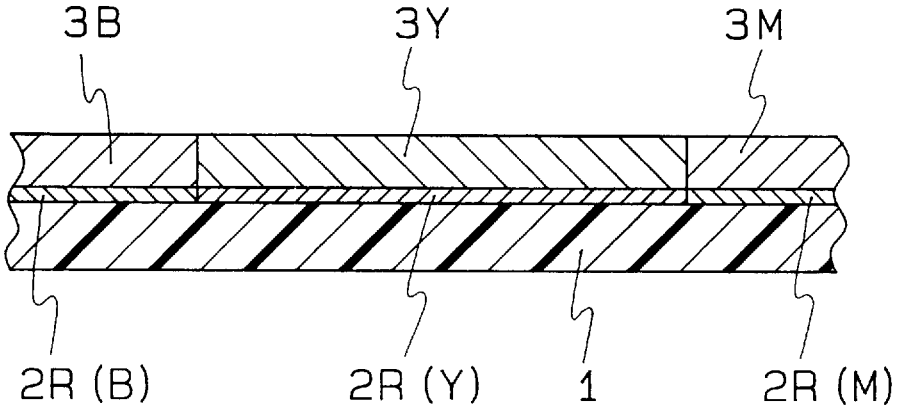
FIG. 4 is a partial sectional view showing the example illustrated in FIG. 3.

FIG. 3 is a partial plan view showing an example of a thermal transfer recording medium according to the second aspect of the present invention, and FIG. 4 is a partial sectional view of this example.

In FIGS. 3 and 4, a release layer 2R(Y), a release layer 2R(M), a release layer 2R(C) and a release layer 2R(B) are disposed on a single foundation 1 in a side-by-side relation, and a yellow heat-meltable ink layer 3Y, a magenta heat-meltable ink layer 3M, a cyan heat-meltable ink layer 3C and a black heat-meltable ink layer 3B are disposed on the release layers 2R(Y), 2R(M), 2R(C) and 2R(B), respectively. The ink layers 3Y, 3M, 3C and 3B (also the release layers 2R(Y), 2R(M), 2R(C) and 2R(B)), each of which preferably has a given constant size, are periodically repeatedly arranged in a side-by-side relation in the longitudinal direction of the foundation 1 in a repeating unit U2 wherein the ink layers 3Y, 3M, 3C and 3B are arranged in a predetermined order. The order of arrangement of the four color ink layers 3Y, 3M, 3C and 3B in the repeating unit U2 can be arbitrarily determined according to the order of transfer of the four color ink layers 3Y, 3M, 3C and 3B.

In the case that the ink layers are transferred in the order of 3Y, 3M, 3C and 3B, the melt viscosities of the release layers are stepwise decreased in the order of 2R(Y), 2R(M), 2R(C) and 2R(B). In the case that the black ink layer 3B is superimposed on other color ink layer, the black ink layer 3B is superimposed on at least one of the yellow, magenta and cyan ink layers 3Y, 3M and 3C or on at least two superimposed ink layers of the yellow, magenta and cyan ink layers 3Y, 3M and 3C, thereby developing a black color.

In the case that the black ink layer 3B is not superimposed on other color ink layer, it is not necessarily required that the release layer 2R(B) corresponding to the black ink layer 3B has the above-mentioned specific relationship with the release layers corresponding to other color ink layers with respect to melt viscosity.

The thermal transfer recording medium of the third aspect of the present invention is a combination of three thermal transfer recording media wherein a yellow heat-meltable ink layer, a magenta heat-meltable ink layer and a cyan heat-meltable ink layer are provided on separate foundations, respectively, with respective release layers being interposed between the foundation and the respective color ink layers, i.e. a first thermal transfer recording medium comprising a foundation, a release layer provided on the foundation and a yellow heat-meltable ink layer provided on the release layer, a second thermal transfer recording medium comprising a foundation, a release layer provided on the foundation and a magenta heat-meltable ink layer provided on the release layer, and a third thermal transfer recording medium comprising a foundation, a release layer provided on the foundation and a cyan heat-meltable ink layer provided on the release layer. The melt viscosities of the respective release layers corresponding to the respective color ink layers are stepwise decreased in the order in which the respective color ink layers are transferred.

The thermal transfer recording medium of the fourth aspect of the present invention is a combination of the thermal transfer recording medium of the third aspect of the present invention, and a thermal transfer recording medium wherein a black heat-meltable ink layer is provided on a foundation with a release layer being interposed therebetween, i.e. a first thermal transfer recording medium comprising a foundation, a release layer provided on the foundation and a yellow heat-meltable ink layer provided on the release layer, a second thermal transfer recording medium comprising a foundation, a release layer provided on the foundation and a magenta heat-meltable ink layer provided on the release layer, a third thermal transfer recording medium comprising a foundation, a release layer provided on the foundation and a cyan heat-meltable ink layer provided on the release layer and a fourth thermal transfer recording medium comprising a foundation, a release layer comprising a wax provided on the foundation and a black heat-meltable ink layer provided on the release layer.

In the case that the ink layers are transferred in the order of yellow, magenta, cyan and black, the melt viscosities of the corresponding release layers are stepwise decreased in this order. In the case that the black ink layer is superimposed on other color ink layer, the black ink layer is superimposed on at least one of the yellow, magenta and cyan ink layers or at least two superimposed ink layers of the yellow, magenta and cyan ink layers, thereby developing a black color.

In the case that the black ink layer is not superimposed on other color ink layer, it is not necessarily required that the release layer of the black thermal transfer recording medium has the above-mentioned specific relationship with the release layers of other color thermal transfer recording media with respect to melt viscosity.

The predetermined temperature at which the melt viscosity of the release layers is determined varies depending upon the transfer condition. Under conditions of a usual printing energy (10 to 30 mJ/mm$^2$), the object of the present invention can be achieved by using the melt viscosity at 100° C.

The method of decreasing stepwise the melt viscosities of the respective release layers corresponding to the yellow, magenta and cyan ink layers and optionally the black ink layer in the order of transfer of the respective color ink layers, layers may comprise suitably selecting the kind of materials, such as wax, for the release layers or the proportion thereof.

For example, with the release layer for the first color ink layer (hereinafter referred to as "first color release layer"), a wax having a high melt viscosity is used as a main component, or a wax having a low melt viscosity is mixed with a heat-meltable resin for adjustment of melt viscosity, thereby obtaining a release layer having a high melt viscosity.

With the release layer for the second color ink layer (hereinafter referred to as "second color release layer"), a wax having a high melt viscosity is mixed with a wax having a low melt viscosity, or a wax having a low melt viscosity is mixed with a heat-metable resin for adjustment of melt viscosity, thereby obtaining a second color release layer having a lower melt viscosity than the first color release layer.

With the release layer for third color ink layer (hereinafter referred to as "third color release layer"), a wax having a low melt viscosity is used as a main component to obtain a third color release layer having a lower melt viscosity than the second color release layer. The wax having a low melt viscosity may be mixed with a heat-meltable resin or a wax having a high melt viscosity for adjustment of melt viscosity.

Examples of the aforesaid wax having a high melt viscosity include natural waxes such as montan wax and ceresine wax; synthetic waxes such as ester wax, polyethylene wax and α-olefin-maleic anhydride copolymer wax; oxidized waxes or modified waxes of the foregoing natural waxes or synthetic waxes.

Examples of the aforesaid wax having a low melt viscosity include paraffin wax, microcrystalline wax, haze wax, bees wax, carnauba wax, candelilla wax, polyethylene wax and Fischer-Tropsch wax; oxidized waxes or modified waxes of the foregoing waxes; higher fatty acids such as myristic acid, palmitic acid and behenic acid; higher aliphatic alcohols such as stearyl alcohol and docosanol; higher fatty acid esters such as higher fatty acid monoglycerides, sucrose higher fatty acid esters and sorbitan higher fatty acid esters.

Examples of the heat-meltable resin (including elastomer) are olefin copolymer resins such as ethylene-vinyl acetate copolymer and ethylene-acrylic ester copolymer, polyamide resins, polyester resins, epoxy resins, polyurethane resins, acrylic resins, vinyl chloride resins, cellulosic resins, vinyl alcohol resins, petroleum resins, phenolic resins, styrene resins, vinyl acetate resins, natural rubber, styrene-butadiene rubber, isoprene rubber, chloroprene rubber, polyisobutylene and polybutene. These heat-meltable resins may be used either alone or in combination.

In the present invention, when the melt viscosity of the release layer to be previously transferred is taken as $\eta_1$, and the melt viscosity of the release layer to be subsequently transferred is taken as $\eta_2$ between the first color release layer and the second color release layer or between the second color release layer and the third color release layer, it is preferable that the relationship represented by the formula:

$$\eta_2/\eta_1<0.7$$

is established. Provision of such melt viscosity difference between the previously transferred release layer and the subsequently transferred release layer ensures the transfer of a subsequent ink dot in a perfect form on the previously transferred ink dot.

Preferably each of the first color release layer, second color release layer and third color release layer has a melt viscosity within the range of 1 to 2,000 cps/100° C. When the melt viscosity is higher than this range, the releasability is prone to be degraded. When the melt viscosity is lower than the range, adhesion between the foundation and the ink layers is prone to become poor, resulting in falling of ink layer. Accordingly it is preferable that the first color release layer, second color release layer and third color release layer have melt viscosities within the above range and the aforesaid melt viscosity difference among them.

Preferably each release layer has a melting point of 50° to 90° C. When the melting point of each release layer is lower than this range, the stability of the thermal transfer recording medium on storage is prone to be degraded. When the melting point is higher than the range, the releasability is prone to be degraded.

Preferably the coating amount (on a dry weight basis, hereinafter the same) of each release layer is from 0.5 to 2 $g/m^2$. When the coating amount of each release layer is smaller than this range, the releasability is prone to be degraded. When the coating amount is larger than the range, the transfer sensitivity is prone to become poor.

Each release layer can be formed by applying a solvent solution, solvent dispersion or aqueous emulsion of a wax and, optionally, a heat-meltable resin onto a foundation, followed by drying. Each ink layer can also be formed by a hot melt coating method.

The respective heat-meltable ink layers for yellow magenta, cyan and black are each a bridgingly transferable layer having a high melt viscosity. Each ink layer is composed of a heat-meltable resin as a main compoennt. A small amount of a wax may be added to the ink layer to adjust the melt viscosity of the ink layer.

Examples of the heat-meltable resin (including elastomer) are olefin copolymer resins such as ethylene-vinyl acetate copolymer and ethylene-acrylic ester copolymer, polyamide resins, polyester resins, epoxy resins, polyurethane resins, acrylic resins, vinyl chloride resins, cellulosic resins, vinyl alcohol resins, petroleum resins, phenolic resins, styrene resins, vinyl acetate resins, natural rubber, styrene-butadiene rubber, isoprene rubber, chloroprene rubber, polyisobutylene and polybutene. These heat-meltable resins may be used either alone or in combination.

The wax can be appropriately selected from those exemplified for the aforesaid release layer.

Preferably each colored ink layer has a softening point of 45° to 90° C. and a melt viscosity of $10^3$ to $10^8$ cps/160° C. When the softening point is lower than the above range, the stability of the thermal transfer recording medium on storage is prone to be degraded. When the softening point is higher than the above range, the transfer sensitivity is prone to be degraded. When the melt viscosity is lower than the above range, the bridging-transferability is prone to be degraded. When the melt viscosity is higher than the above range, the transfer sensitivity is prone to be degraded.

Usable as the coloring agent for the ink layers are any coloring agents for use in thermal transfer recording media for color image formation of this type. Preferably respective coloring agents for yellow, magenta and cyan are transparent ones. Usually coloring agents for black are opaque ones.

Examples of transparent coloring agents for yellow include organic pigments such as Naphthol Yellow S, Hansa Yellow 5G, Hansa Yellow 3G, Hansa Yellow G, Hansa Yellow GR, Hansa Yellow A, Hansa Yellow RN, Hansa Yellow R, Benzidine Yellow, Benzidine Yellow G, Benzidine Yellow GR, Permanent Yellow NCG and Quinoline Yellow Lake, and dyes such as Auramine. These coloring agents can be used singly or in combination of two or more species thereof.

Examples of transparent coloring agents for magenta include organic pigments such as Permanent Red 4R, Brilliant Fast Scarlet, Brilliant Carmine BS, Permanent Carmine FB, Lithol Red, Permanent Red F5R, Brilliant Carmine 6B, Pigment Scarlet 3B, Rhodamine Lake B, Rhodamine Lake Y and Arizalin Lake, and dyes such as Rhodamine. These coloring agents can be used singly or in combination of two or more species thereof.

Examples of transparent coloring agents for cyan include organic pigments such as Victoria Blue Lake, metal-free Phthalocyanine Blue, Phthalocyanine Blue and Fast Sky Blue, and dyes such as Victoria Blue. These coloring agents can be used singly or in combination of two or more species thereof.

Herein the term "transparent pigment" means a pigment which gives a transparently colored ink when dispersed in a transparent vehicle.

Examples of coloring agents for black include inorganic pigments such as carbon black, organic pigments such as Aniline Black, and dyes such as Nigrosine. These coloring agents can be used singly or in combination of two or more species thereof.

Preferably the content of the coloring agent in each colored ink layer is from about 10 to about 50% by weight.

Preferably the coating amount (on a dry weight basis, hereinafter the same) of each ink layer is from about 1 to about 6 $g/m^2$.

Each colored ink layer can be formed by applying on each release layer a coating liquid which is prepared by dissolving a heat-meltable resin and, optionally, a wax into a suitable solvent and dissolving or dispersing a coloring agent into the resulting solution, followed by drying.

As the foundation, there can be used polyester films such as polyethylene terephthalate film, polyethylene naphthalate film and polyarylate film, polycarbonate film, polyamide film, aramid film, and other various plastic films commonly used for the foundation of ink ribbons of this type. Thin paper sheets of high density such as condenser paper can also be used. The thickness of the foundation is preferably from about 1 to about 10 $\mu$m, more preferably from about 1 to 6 $\mu$m in view of ensuring good thermal conduction.

With a recording medium used in a thermal transfer printer equipped with a thermal head, a conventionally known stick-preventive layer is preferably provided on the back side (the side adapted to come into slide contact with the thermal head) of the foundation. Examples of the materials for the stick-preventive layer include various heat-resistant resins such as silicone resins, fluorine-containing resins and nitrocellulose resins, and other resins modified with these heat-resistant resins, such as silicone-modified urethane resins and silicone-modified acrylic resins, and mixtures of the foregoing heat-resistant resins and lubricating agents.

The formation of a multi-color or full-color image with use of the thermal transfer recording medium of the present invention is preferably performed as follows: With use of a thermal transfer printer, the yellow ink layer (including the corresponding release layer, hereinafter the same), the magenta ink layer and the cyan ink layer are selectively melt-transferred onto a receptor in a predetermined order according to respective separation color signals of an original multi-color or full-color image, i.e. yellow signals, magenta signals and cyan signals to form yellow ink dots, magenta ink dots and cyan ink dots on the receptor in a predetermined order, yielding a yellow separation image, a magenta separation image and a cyan separation image superimposed on the receptor. The order of transfer of the yellow ink layer, the magenta ink layer and the cyan ink layer can be determined as desired. When a usual full-color or multi-color image is formed, all the three color ink layers are selectively transferred according to three color signals to form three color separation images on the receptor. When only two color signals are present, the corresponding two of the three color ink layers are selectively transferred to form two color separation images of a yellow separation image, a magenta separation image and a cyan separation image.

Thus there is obtained a multi-color or full-color image comprising (A1) at least one region wherein a color is developed by virtue of subtractive color mixture of at least two superimposed inks of yellow, magenta and cyan, or (B1) a combination of the region (A1), and at least one region of single color selected from yellow, magenta and cyan wherein different color inks are not superimposed. Herein a region where yellow ink dots and magenta ink dots are present in a superimposed state develops a red color; a region where yellow ink dots and cyan ink dots are present in a superimposed state develops a green color; a region where magenta ink dots and cyan ink dots are present in a superimposed state develops a blue color; and a region where yellow ink dots, magenta ink dots and cyan ink dots are present in a superimposed state develops a black color. A region where only yellow ink dots, magenta ink dots or cyan ink dots are present in a non-superimposed state develops a yellow color, a magenta color or a cyan color.

In the above manner, a black color is developed by superimposing yellow ink dots, magenta ink dots and cyan ink dots. However, a black color may be obtained by using only black ink dots instead of using three color ink dots. In that case, the black color may be obtained by superimposing black ink dots on at least one of yellow ink dots, magenta ink dots and cyan ink dots, or on superimposed ink dots of at least two of yellow ink dots, magenta ink dots and cyan ink dots.

In the above, explanations have been given on the case where a mulit-color or full-color image is formed on a rough paper sheet with use of the thermal transfer recording medium of the present invention. However, the thermal transfer recording medium of the present invention can also be favorably used to form a multi-color or full-color image on a receptor having good surface smoothness.

Usable as the thermal transfer printer wherein the thermal transfer recording medium of the present invention is used are a variety of thermal transfer printers such as one utilizing laser beam, one utilizing infrared ray and electrothermal transfer printing type, besides one utilizing a thermal head.

The present invention will be more fully described by way of Examples. It is to be understood that the present invention is not limited to the Examples, and various change and modifications may be made in the invention without departing from the spirit and scope thereof.

EXAMPLE 1

A 3.5 $\mu$m-thick polyethylene terephthalate film formed on one side thereof with a 0.1 $\mu$m-thick stick-preventive layer composed of a silicone resin was used as a foundation.

Onto the opposite side of the foundation with respect to the stick-preventive layer were applied and dried coating liquids for release layer which were selected from those shown in Table 1 and corresponded to the respective color ink layers shown in Table 2 according to the combinations with the respective color ink layers arranged in FIGS. 1 and 2, thereby forming the respective release layers each having a coating amount of 1.0 g/m$^2$.

Onto the thus formed release layers were applied and dried the respective color ink coating liquids having the formulas as shown in Table 3 according to the combinations with the respective release layers shown in Table 2, thereby forming respsective color ink layers each having a coating amount of 2.0 g/m$^2$. Thus, a thermal transfer recording medium having the structure and color arrangement as shown in FIGS. 1 and 2 was obtained.

EXAMPLE 2

The same procedures as in Example 1 except that release layers corresponding to the respective color ink layers were formed according to the combinations with the respective color ink layers as shown in Table 2 were repeated to give a thermal transfer recording medium.

COMPARATIVE EXAMPLE

The same procedures as in Example 1 except that the same release layer (R4) was formed for the respective color ink layers as shown in Table 2 were repeated to give a thermal transfer recording medium.

TABLE 1

| Release layer | Formula of coating liquid (parts by weight) | | Melting point (°C.) | Melt viscosity (cps/100° C.) |
|---|---|---|---|---|
| R1 | Oxidized polyethylene wax | 8 | 80 | 100 |
| | Toluene | 92 | | |
| R2 | Oxidized polyethylene wax | 7 | | |
| | Paraffin wax | 1 | 79 | 81 |
| | Toluene | 92 | | |
| R3 | Oxidized polyethylene wax | 4 | | |
| | Paraffin wax | 4 | 77 | 60 |
| | Toluene | 92 | | |
| R4 | Paraffin wax | 8 | 75 | 7 |
| | Toluene | 92 | | |

TABLE 2

| | Ex. 1 | | Ex. 2 | | Com. Ex. | |
|---|---|---|---|---|---|---|
| Color ink layer | Release layer | Melt viscosity (cps/100° C.) | Release layer | Melt viscosity (cps/100° C.) | Release layer | Melt viscosity (cps/100° C.) |
| Yellow | R1 | 100 | R1 | 100 | R4 | 7 |
| Magenta | R3 | 60 | R2 | 81 | R4 | 7 |
| Cyan | R4 | 7 | R3 | 60 | R4 | 7 |

TABLE 3

| Formula of coating liquid for color ink layer (parts by weight) | Yellow | Magenta | Cyan |
|---|---|---|---|
| Ethylene-vinyl acetate copolymer (melt index: 150/190° C.) | 60 | 60 | 60 |
| Petroleum resin | 20 | 20 | 20 |
| Pigment Yellow GRT | 20 | | |
| Brilliant Carmine 6B307 | | 20 | |
| Phthalocyanine Blue KRO | | | 20 |
| Toluene | 400 | 400 | 400 |

TABLE 3-continued

| Formula of coating liquid for color ink layer (parts by weight) | Yellow | Magenta | Cyan |
|---|---|---|---|
| Melt viscosity of color ink layer (cps/160° C.) | $5 \times 10^4$ | $5 \times 10^4$ | $5 \times 10^4$ |

With use of each of the thus obtained thermal transfer recording media, superimposing-printing on one dot basis was performed in the order of yellow, magenta and cyan under the printing conditions mentioned below. With respect to the first color ink dots (the yellow ink dots formed on the receptor), the second color ink dots (the magenta ink dots formed on the yellow ink dots) and the third color ink dots (the cyan ink dots formed on the magenta ink dots), the ratio of the area of the ink dot to the area (0.0061 $mm^2$) of one heat-generating element (hereinafter referred to as "dot-transfer ratio") was determined. The dot-transfer ratio is an average value of those for 432 dots. The transferability of the first color ink on the receptor and the superimposing quality of the second color ink and third color ink were evaluated according to the following criterion. The results are shown in Table 4.

Printing conditions

Thermal transfer printer: PCPR 150 V made by NEC Corp.

Applied energy: 18 $mJ/mm^2$

Printing speed: 100 cps

Receptor: PPC paper (Bekk smoothness: 60 seconds)

Evaluation criterion

A . . . Dot-transfer ratio: 0.95 to 1.05

B . . . Dot-transfer ratio: not less than 0.90 and less than 0.95

C . . . Dot-transfer ratio: less than 0.90

A dot-transfer ratio of not less than 0.90 is practical.

TABLE 4

| | Dot-transfer ratio | | |
|---|---|---|---|
| | First color ink dot (yellow) | Second color ink dot (magenta) | Third color ink dot (cyan) |
| Ex. 1 | A | A | A |
| Ex. 2 | A | B | B |
| Com. Ex. | A | C | C |

In addition to the materials and ingredients used in the Examples, other materials and ingredients can be used in Examples as set forth in the specification to obtain substantially the same results.

The thermal transfer recording medium of the present invention can give first color ink dots of high quality on a rough paper because the heat-meltable ink layers for respective colors are bridgingly transferable.

Further, respective release layers interposed between the foundation and the heat-meltable ink layers for respective colors have decreasing melt viscosities in the order of transfer of the respective color ink layers, thereby favorably transferring second color ink dots on the first color ink dots and further third color ink dots on the second color ink dots. Accordingly, a desired color mixture is obtained, resulting in a multi-color or full-color image of high quality with good color reproducibility.

Moreover, between the melt viscosity $\eta_1$ of the release layer corresponding to the color ink layer to be previously transferred and the melt viscosity $\eta_2$ of the relase layer corresponding to the color ink layer to be subsequently transferred, the relationship represented by the formula:

$$\eta_2/\eta_1<0.7$$

is established, resulting in good superimposition of different color ink dots.

What is claimed is:

1. A thermal transfer recording medium for color image formation for use in a method for forming a color image comprising selectively heat-transferring at least two of a yellow heat-meltable ink layer, a magenta heat-meltable ink layer and a cyan heat-meltable ink layer on a receptor in a predetermined order, thereby forming a color image, said color image comprising at least one color region wherein at least two different color ink dots of the yellow ink, magenta ink and cyan ink are present in a superimposed state to develop a color by virtue of subtractive color mixture, or a combination of said color region with at least one region of single color comprising color ink dots selected from the yellow ink, magenta ink and cyan ink in a non-superimposed state, the thermal transfer recording medium comprising a single foundation; a yellow heat-meltable ink layer, a magenta heat-meltable ink layer and a cyan heat-meltable ink layer disposed on the foundation in a side-by-side relation in a predetermined order; and release layers, each of said release layers corresponding to a respective color ink layer and comprising a wax interposed between the foundation and the respective color ink layer, the melt viscosity of each release layer at a predetermined temperature being decreased stepwise in the order in which the respective color ink layers are transferred.

2. The thermal transfer recording medium of claim 1, wherein the melt viscosity $\eta_1$ of a first release layer corresponding to a first color ink layer selected from the yellow, magenta and cyan ink layers and the melt viscosity $\eta_2$ of a second release layer corresponding to a second color ink layer selected from the yellow, magenta and cyan ink layers have a relationship represented by the formula:

$$\eta_2/\eta_1<0.7$$

provided that said first color ink layer is transferred prior to said second color ink layer.

3. A thermal transfer recording medium for color image formation for use in a method for forming a color image comprising selectively heat-transferring at least three of a yellow heat-meltable ink layer, a magenta heat-meltable ink layer, a cyan heat-meltable ink layer and a black heat-meltable ink layer on a receptor in a predetermined order, thereby forming a color image, said color image comprising at least one first color region wherein at least two different color ink dots of the yellow ink, magenta ink and cyan ink are present in a superimposed state to develop a color by virtue of subtractive color mixture and at least one second color region wherein black ink dots are present in a superimposed state on color ink dots selected from at least one of the yellow ink, magenta ink and cyan ink or on at least two superimposed ink dots selected from the yellow ink, magenta ink and cyan ink to develop a black color, or a combination of said first and second color regions with at least one region of single color comprising color ink dots selected from the yellow ink, magenta ink, cyan ink and black ink in a non-superimposed state, the thermal transfer recording medium comprising a single foundation; a yellow heat-meltable ink layer, a magenta heat-meltable ink layer, a cyan heat-meltable ink layer and a black heat-meltable ink layer disposed on the foundation in a side-by-side relation in a predetermined order; and release layers, each of said release layers corresponding to a respective color ink layer and comprising a wax interposed between the foundation and the respective color ink layer, the melt viscosity of each said release layer at a predetermined temperature being decreased stepwise in the order in which the respective color ink layers are transferred.

4. The thermal transfer recording medium of claim 3, wherein the melt viscosity $\eta_1$ of a first release layer corresponding to a first color ink layer selected from the yellow, magenta, cyan and black ink layers and the melt viscosity $\eta_2$ of a second release layer corresponding to a second color ink layer selected from the yellow, magenta, cyan and black ink layers have a relationship represented by the formula:

$$\eta_2/\eta_1<0.7$$

provided that said first color ink layer is transferred prior to said second color ink layer.

5. An assembly of plural thermal transfer recording media for color image formation for use in a method for forming a color image comprising selectively heat-transferring at least two of a yellow heat-meltable ink layer, a magenta heat-meltable ink layer and a cyan heat-meltable ink layer on a receptor in a predetermined order, thereby forming a color image, said color image comprising at least one color region wherein at least two different color ink dots of the yellow ink, magenta ink and cyan ink are present in a superimposed state to develop a color by virtue of subtractive color mixture, or a combination of said color region with at least one region of single color comprising color ink dots selected from the yellow ink, magenta ink and cyan ink in a non-superimposed state, the assembly comprising a first thermal transfer recording medium comprising a first foundation, a first release layer comprising a wax provided on said first foundation and a yellow heat-meltable ink layer provided on said first release layer, a second thermal transfer recording medium comprising a second foundation, a second release layer comprising a wax provided on said second foundation and a magenta heat-meltable ink layer provided on said second release layer, and a third thermal transfer recording medium comprising a third foundation, a third release layer comprising a wax provided on said third foundation and a cyan heat-meltable ink layer provided on said third release layer, the melt viscosity of each release layer at a predetermined temperature being decreased stepwise in the order in which the respective color ink layers are transferred.

6. The thermal transfer recording medium of claim 5, wherein the melt viscosity $\eta_1$ of a first release layer corresponding to a first color ink layer selected from the yellow, magenta and cyan ink layers and the melt viscosity $\eta_2$ of a second release layer corresponding to a second color ink layer selected from the yellow, magenta and cyan ink layers have a relationship represented by the formula:

$$\eta_2/\eta_1<0.7$$

provided that said first color ink layer is transferred prior to said second color ink layer.

7. An assembly of plural thermal transfer recording media for color image formation for use in a method for forming a color image comprising selectively heat-transferring at least two of a yellow heat-meltable ink layer, a magenta heat-meltable ink layer, a cyan heat-meltable ink layer and a black heat-meltable ink layer on a receptor in a predetermined order, thereby forming a color image, said color image comprising at least one first color region wherein at least two different color ink dots of the yellow ink, magenta ink and cyan ink are present in a superimposed state to develop a color by virtue of subtractive color mixture and at least one second color region wherein black ink dots are present in a superimposed state on color ink dots selected from at least one of the yellow ink, magenta ink and cyan ink or on at least two superimposed ink dots selected from the yellow ink, magenta ink and cyan ink to develop a black color, or a combination of said first and second color regions with at least one region of single color comprising color ink dots selected from the yellow ink, magenta ink, cyan ink and black ink in a non-superimposed state, the assembly comprising a first thermal transfer recording medium comprising a first foundation, a first release layer comprising a wax provided on said first foundation and a yellow heat-meltable ink layer provided on said first release layer, a second thermal transfer recording medium comprising a second foundation, a second release layer comprising a wax provided on said second foundation and a magenta heat-meltable ink layer provided on said second release layer, a third thermal transfer recording medium comprising a third foundation, a third release layer comprising a wax provided on said third foundation and a cyan heat-meltable ink layer provided on said third release layer and a fourth thermal transfer recording medium comprising a fourth foundation, a fourth release layer comprising a wax provided on said fourth foundation and a black heat-meltable ink layer provided on said fourth release layer, the melt viscosity of each release layer at a predetermined temperature being decreased stepwise in the order in which the respective color ink layers are transferred.

8. The thermal transfer recording medium of claim 7, wherein the melt viscosity $\eta_1$ of a first release layer corresponding to a first color ink layer selected from the yellow, magenta, cyan and black ink layers and the melt viscosity $\eta_2$ of a second release layer corresponding to a second color ink layer selected from the yellow, magenta, cyan and black ink layers have a relationship represented by the formula:

$$\eta_2/\eta_1<0.7$$

provided that said first color ink layer is transferred prior to said second color ink layer.

* * * * *